US007530891B2

(12) United States Patent
Perrin

(10) Patent No.: US 7,530,891 B2
(45) Date of Patent: May 12, 2009

(54) THERMALLY-ACTUATED CARTRIDGE AND FIRE DAMPER

(75) Inventor: Richard Perrin, Kent (GB)

(73) Assignee: Kent Tooling & Components Limited, Kent (GB)

( * ) Notice: Subject to any disclaimer, the term of this patent is extended or adjusted under 35 U.S.C. 154(b) by 96 days.

(21) Appl. No.: 10/525,251

(22) PCT Filed: Aug. 19, 2003

(86) PCT No.: PCT/GB03/03651

§ 371 (c)(1),
(2), (4) Date: Aug. 5, 2005

(87) PCT Pub. No.: WO2004/016319

PCT Pub. Date: Feb. 26, 2004

(65) Prior Publication Data

US 2006/0014486 A1 Jan. 19, 2006

(30) Foreign Application Priority Data

Aug. 19, 2003 (GB) ..... 0219297.9

(51) Int. Cl.
*A62C 2/06* (2006.01)
*E05F 15/20* (2006.01)

(52) U.S. Cl. ..... 454/369; 49/7

(58) Field of Classification Search ..... 454/358, 454/369; 137/72, 74, 75; 236/96
See application file for complete search history.

(56) References Cited

U.S. PATENT DOCUMENTS 4,184,288 A * 1/1980 Magill et al. ..... 49/7
4,559,867 A 12/1985 Bailey et al.
4,625,626 A 12/1986 Aalton et al.
4,958,687 A 9/1990 Nakagawa
5,779,540 A * 7/1998 Nailor ..... 454/369

FOREIGN PATENT DOCUMENTS

| | | |
|---|---|---|
| EP | 1 267 133 | 12/2002 |
| FR | 2 494 347 | 5/1982 |
| FR | 2 757 775 | 7/1998 |
| GB | 1 534 026 | 11/1978 |

(Continued)

*Primary Examiner*—Steve McAllister
*Assistant Examiner*—Helena Kosanovic
(74) *Attorney, Agent, or Firm*—Dickstein Shapiro LLP

(57) ABSTRACT

A thermally-actuated cartridge (21) has a center pin (24) which is arranged to protrude through the rear of a cartridge holder (23) when the cartridge assembly (21) is not set, so that it is apparent that the cartridge assembly (21) is not set. In a fire damper for an airflow duct, the cartridge assembly (21) is used as a detent to hold a damper flap (7) open. There is a particularly convenient way of mounting the detent arrangement by having a U-shaped member (9) which carries a limb (15) acting as a backing piece for a retention quadrant (7) and a sprung bracket (16) which are squeezed together by the cartridge assembly (21). The U-shaped member (9) is mounted by a means of a limb extension (10) which slots over the damper flap axle (5) and is held by a rivet (13) in the correct orientation, the cartridge assembly (21) being screwed through a threaded bore formed by upsetting or swaging a limb (14) of the U-member (9) through a hole in the extension (10).

25 Claims, 3 Drawing Sheets

FOREIGN PATENT DOCUMENTS

| | | |
|---|---|---|
| GB | 2 032 272 | 5/1980 |
| GB | 2 121 531 | 12/1983 |
| GB | 2 203 646 | 10/1988 |
| GB | 2 213 719 | 8/1989 |
| GB | 2 255 014 | 10/1992 |
| WO | WO 86/05107 | 9/1986 |

* cited by examiner

THERMALLY-ACTUATED CARTRIDGE AND FIRE DAMPER

BACKGROUND OF THE INVENTION

The present invention relates generally to thermally-actuated cartridges for fire dampers for airflow ducts, but also relates more generally to any thermally-actuated mechanism and any damper for airflow ducts.

WO 02/43810 and EP0 300992 disclose the use of thermal cartridges for closing the damper element of a fire damper in an airflow duct. There can be problems with the cartridge if it is wrongly installed. For instance, if it is screwed in too tightly, the solder (or other heat-softenable or meltable material) can rupture, but there is no indication that this has occurred so that if there is a fire, the damper element does not close.

The installation of a member for carrying the cartridge and arranging for the retention of the damper element can give significant difficulty.

THE INVENTION

The present invention provides a thermally-actuated cartridge, a thermally-actuated mechanism and a damper, as well as the airflow insulation.

The movable member protrudes through the opening when the cartridge is triggered. This has the advantage of indicating externally that an excessive temperature has been reached. However, there is also the advantage that if the cartridge is say screwed in too hard, and the solder ruptured, it is apparent from outside that the mechanism would be inoperative. In effect, the invention provides fail-safe operation. There is also the advantage that the protruding end portion of the movable member can be arranged to actuate a microswitch, which can give a warning signal.

Preferably the arrangement is such that when the cartridge or mechanism is set, the movable member does not protrude at all or substantially through the opening, the end of the movable member preferably being flush with the opening. In this way, a protruding end gives a clear signal that the cartridge or mechanism is not set. However, if the end of the movable member protrudes when the cartridge or mechanism is set, the end portion can be profiled or marked so that its movement is apparent.

The difficulty of installation can be avoided using the damper. The U-shaped member is easily installed in that the second limb can be engaged over the damper element axle to locate the U-shaped member and then the U-shaped member firmly fixed using the securing means to secure the second limb to the inner circumferential wall of the ducting.

PREFERRED EMBODIMENT

The invention will be further described, by way of example, with reference to the accompanying drawings, in which.

Figure 2:
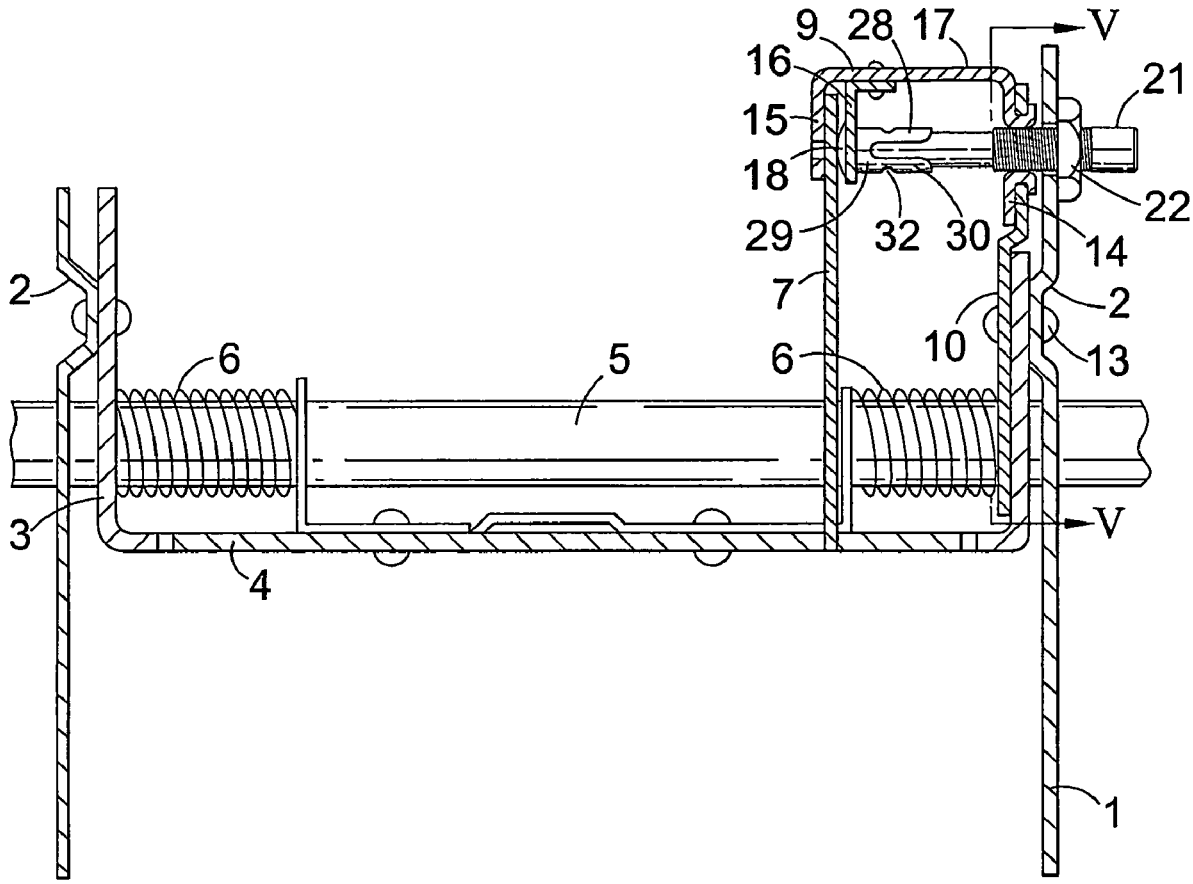
FIG. 2 is a part longitudinal section along the plane II-II in FIG. 1.
Figure 3:
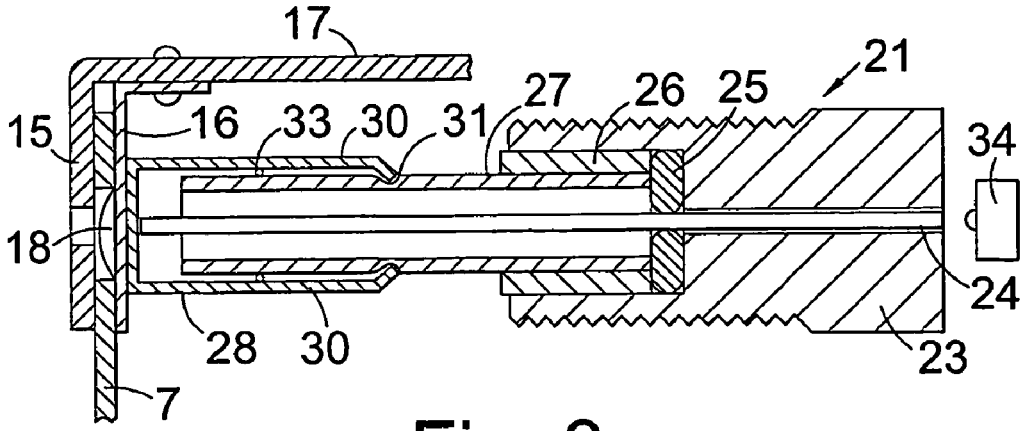
FIG. 3 is an enlarged part-longitudinal section through the thermal cartridge shown in FIG. 2, in the set configuration.
Figure 4:
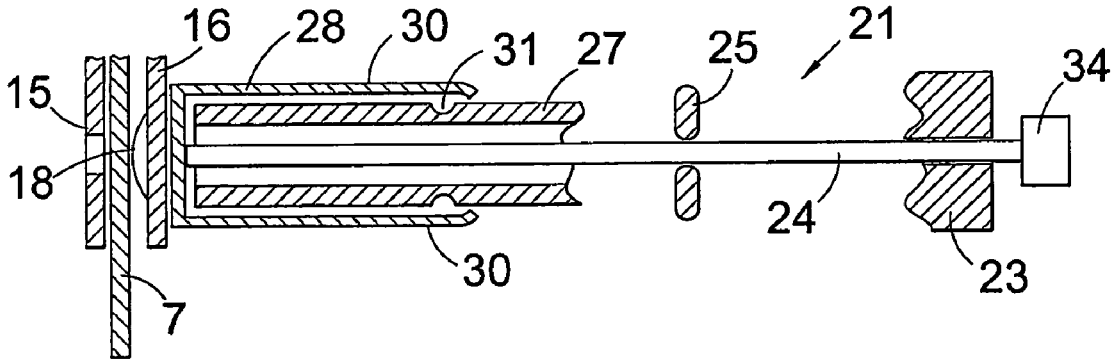
Figure 5:
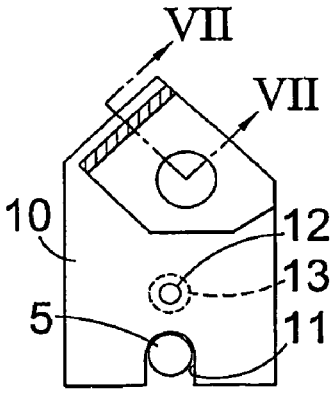
Figure 6:
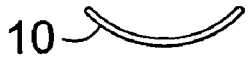
Figure 7:
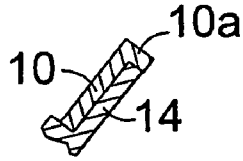

FIG. 4 corresponds to FIG. 3, but shows the cartridge when it has triggered;

FIG. 5 shows the right-hand end of the U-shaped member (as seen looking in FIG. 2), in section along the plane V-V indicated in FIG. 2;

FIG. 6 is a view of the end limb of FIG. 5 looking in the direction of the arrow VI in FIG. 5; and FIG. 7 is a section of the end limb taken along the line VII-VII in FIG. 5.

Figure 1:
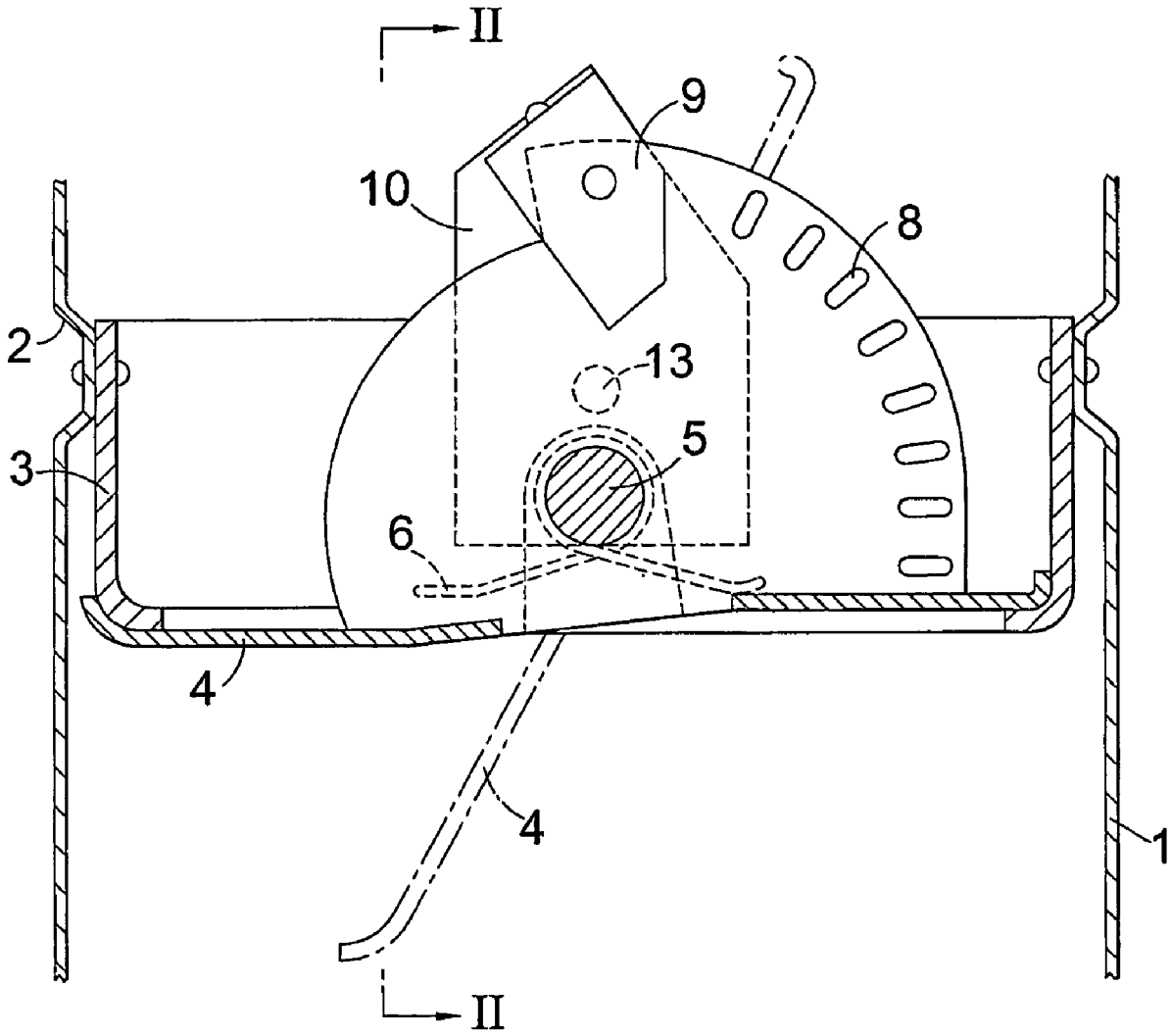
FIG. 1 is a part longitudinal section through a section of airflow ducting which forms a fire damper.

FIGS. 1 and 2 show ducting 1 for instance an air-conditioning installation. A damper is provided by swaging the ducting 1 inwards at 2, riveting a cylindrical rim 3 to the swaged-in part 2 and pivoting a damper element or flap 4 on a transverse axle 5. In the closed position shown in full lines in FIG. 1, the periphery of the flap 4 bears against the rim 3, effectively to close the duct. The fully open position of the flap 4 is indicated in chain-dotted lines in FIG. 1. At the sides, the flap 4 is suitably cut away, generally as illustrated in WO 02/43810. Two helical springs 6 bias the flap 4 into its closed position.

A generally sector-shaped retention member or quadrant 7 is held in a slot in the flap 4 and secured by the axle 5 which passes through a hole in the quadrant 7 so that the quadrant 7 is fixed relative to the flap 4. The quadrant 7 has a series of cut-outs or notches 8 adjacent its periphery.

A U-shaped support member 9 is mounted in position in the following manner. The U-shaped support member 9 has at right angles thereto a profiled limb extension 10 which has a notch 11 in its lower end (see FIG. 5) which locates over the axle 5 and has a bore 12 by which the extension 10 is secured to the inner circumference of the ducting 1 at the swaging 2 by securing means in the form of a rivet 13 (see FIG. 2). The notch 5 ensures that the limb extension 10 is correctly aligned. The limb 14 of the support member 9 which is nearer the wall of the ducting 1 is swaged onto the end of the extension 10, as shown in FIG. 2, thus fixing the limb extension 10 to the support member 9. The swaging is taken through a circular bore in the limb extension 10, and is tapped with a female thread. As can be seen in FIG. 2, the extension 2 is suitably profiled. The part adjacent the axle 5 is curved to mate properly with the rim 3 (see FIG. 6) and there is a small side flange 10*a* to engage the edge of the limb 14 (see FIG. 7).

The other limb 15 of the support member 9 is internally of the quadrant 7. Externally of the quadrant 7, a sprung L-bracket 16 is riveted to the base 17 of the support member 9. The bracket 16 has pressed in it a dimple 18 which is roughly the same size as the cut-outs in the quadrant 7 and which, in the set position of the damper, engages in a cut-out 8.

A cartridge assembly 21 is passed through a hole in the ducting 1 and screwed into the tapped swaging of the limb 14, being held in place by a lock-nut 22. Though not shown, the lock-nut 22 is screwed up until the wall of the ducting 1 firmly abuts the swaging of the limb 14, the wall deforming to permit this. The cartridge assembly 21 is formed of a body member or cartridge holder 23 (see FIGS. 3 and 4) having a central bore accommodating a movable member in the form of a rod or pin 24 and a counter bore accommodating an O-ring 25 and a plastic sleeve 26. The O-ring 25 applies friction to the pin 24 and holds it in the assembly 21 (as an alternative, or in addition, ears can be formed on the pin 24 by swaging, to the left of the O-ring 25, as looking in FIG. 2). The end of the pin 24 does not protrude substantially through the external opening in the holder 23, and the end of the pin 24 is preferably flush with the end face of the holder 23. The cartridge proper, in the form of a cylindrical casing 27, is pressed into and held by the sleeve 26. On the end of the casing 27 there is a detent body or claw holder 28 which has an actuating member or head in the form of a short end cap 29 (see FIG. 2) carrying two elongate detents or claws 30. The claws have inturned ends which engage in an annular groove 31 in the casing 27. The claws 30 have circular openings 32 near their roots, to make them less rigid, and adjacent each opening 32 a heat-softenable or meltable (fusible) material in the form of solder 33 is applied so that it adheres both to the claws 30 and to the outside of the casing 27. As the force on the ends of the claws is always in a radial direction before the solder 33 melts, the solder 33 is under tension.

In order to set the fire damper, the flap 4 is opened using a key and is held at a suitable inclination. The cartridge assembly 21 is then screwed in and the flap 4 positioned so that the dimple 18 engages in a cut-out 8. The end cap 29 should abut firmly against the spring bracket 16, which acts as an engaging member, pressing the quadrant 7 against the limb 15, which then acts as a backing piece, thereby securing the quadrant 7 and holding the flap 4 in an open position. The lock nut 22 is applied.

If the temperature rises excessively, the solder 33 melts. The springs 6 are sufficiently strong to cam the dimple 18 out of the cut-out 8, pushing the claw holder 28 to the right as shown in FIG. 3 and camming the ends of the claws 30 out of the groove 31 (in a radial direction) so that the configuration is as shown in FIG. 4. The movement of the claw holder 28 causes the pin 24 to move to the right (as shown in FIG. 4) and its end now protrudes from the cartridge holder 23. This indicates that the cartridge assembly 21 is no longer set. If desired, a microswitch 34 can be mounted so as to be actuated by the pin 24, to give a signal.

In a variation of the arrangement, not illustrated, there is no thermal cartridge as such. The O-ring 25 is replaced by a disc and the rod 24 suitably shortened and the casing 27 is arranged so as to abut directly on the spring bracket 16. The rod 24 is connected to a solenoid which, when energised, applies a constant force on the rod 24, urging it to the left in FIG. 3 and holding the flap 4 open. For adjustment or on an excessive temperature rise, the solenoid is de-energised, the rod 24 moves to the right and the flap 4 is freed.

In a further variation, not illustrated, where the thermal cartridge is not wanted, the same basic arrangement can be used. It would be possible to use a dummy cartridge with equivalent proportions, but in practice, the cartridge is omitted and a longer pin 24 is used. The left-hand end of the pin engages in the dimple 18 and the right-hand end of the pin 24 can be acted on by say a solenoid. In this case, as the right-hand end of the pin 24 will protrude all the time, it can have steps formed in it or can be marked with say red paint to give an indication whether the arrangement is set or not. If as in yet a further variation, the spring bracket 16 is omitted, the pin 24 can act both as the moving member and as the engaging member and engage in one of the cut-outs 8.

EXAMPLE

In one preferred example, the following components were used:

Spring bracket 16—spring quality stainless steel;
U-member 9—plated mild steel;
Casing 27—7 mm diameter, brass;
Claw holder 28—brass;
Cartridge holder 23—mild steel, plated;
O-ring 25—neoprene;
Plastic sleeve 26—PVC;
Solder—melting point preferably 72° C., but according to installation requirements, up to 102° C.;
Centre bore in cartridge holder 23—nominal 4 mm;
Pin 24—nominal 4 mm, stainless steel;
Movement of claw holder 28—2 mm;
Diameter of cartridge holder 23—12.5 mm;
Depth of swaging 2—2.5 mm.

Unless the context clearly requires otherwise, throughout the description and the Claims, the words "comprise" and the like are used in an inclusive as opposed to an exclusive or exhaustive sense, that is to say, in the sense of "include, but not limited to".

The present invention has been described above purely by way of example, and modifications can be made within the spirit of the invention. The invention also consists in any individual features described or implicit herein or shown or implicit in the drawings or any combination of any such features or any generalisation of any such features or combination. Each feature disclosed in the specification, including the Claims, abstract and drawings, may be replaced by alternative features serving the same, equivalent or similar purposes, unless expressly stated otherwise.

The invention claimed is:

1. A damper for an air flow duct comprising:
ducting;
a damper element located internally from an inner surface of a circumferential wall of the ducting and movable between a first, closed position and a second, open position;
biasing means biasing the damper element into its closed position; and
retention means for retaining the damper element in an open position,
the retention means comprising:
an actuating member;
a retention member which is fixed relative to the damper element and can be secured by the action of the actuating member to retain the damper element in an open position, which securing can be released by movement of the actuating member to release the damper element so that the latter is moved by the biasing means into its closed position;
a body member which is fixed to an opening in the inner surface and an outer surface of the circumferential wall of the ducting, the body member having a through-hole which passes from an exterior to an interior of the body member; and
a movable member in the through-hole and arranged so that it moves when the actuating member moves, the movable member being arranged such that it protrudes or protrudes further from an opening in the exterior of the body member externally from the outer surface of the circumferential wall of the ducting when the actuating member moves to release the damper element.

2. The damper of claim 1, wherein the actuating member comprises a temperature-sensitive element for releasing the retention member to release the damper element when the temperature-sensitive element reaches a certain temperature.

3. The damper of claim 1, wherein the movable member is an axially-movable rod.

4. The damper of claim 1, wherein the body member comprises a cylindrical casing mounted by a holder, said opening in the exterior of the body member being in the holder.

5. The damper of claim 2, wherein the body member is extended, the temperature-sensitive element being adjacent one end of the body member and the opening in the exterior of the body member being adjacent the other end of the body member.

6. The damper of claim 4, wherein the casing is an elongate cylinder and the holder is cylindrical with a bore in one end receiving an end portion of the cylinder, said opening in the exterior of the body member being at the other end.

7. The damper of claim 2, wherein the temperature-sensitive element comprises a heat-softenable or meltable material which when hard prevents movement of the movable member and when soft or molten permits movement of the movable member.

8. The damper of claim 7, the temperature-sensitive element being such that the actuating member can move relative to the casing when said certain temperature is reached, the movable member being in contact with or being contactable by the actuating member when the actuating member moves so that the movement of the actuating member causes the movable member to move and protrude or protrude further through said opening.

9. The damper of claim 8, wherein the casing has a recess, the movable member is within the casing, and the actuating member has a detent engaging in the recess such that when the heat-softenable or meltable material is soft or molten, a force on the actuating member in a direction of its movement with respect to the casing would cam the detent out of the recess in a direction generally at right angles to the direction of movement of the actuating member and release the actuating member, thereby causing the movable member to move, the heat-softenable or meltable material being between the detent and the casing and being such that said force applies a force on the heat-softenable or meltable material generally at right angles to the direction of movement of the actuating member.

10. The damper of claim 9, wherein the heat-softenable or meltable material is in tension under the action of said force on the actuating member.

11. The damper of claim 8, wherein the actuating member comprises an end cap which is adjacent or abuts the end of the movable member, the end cap having elongate detents which extend outside the casing and parallel to the movable member.

12. The damper of claim 1, the retention means further comprising a fixed backing piece on the other side of the retention member to the actuating member so that the actuating member can press the retention member against the backing piece.

13. The damper of claim 1, the retention means further comprising a sprung piece fixed to the ducting and acting as an engaging member such that the actuating member can engage the sprung piece to press the sprung piece against the retention member.

14. The damper of claim 1, wherein the damper element is rotatably mounted for movement between its closed position and an open position, and the retention member is generally sector shaped.

15. The damper of claim 1, wherein the retention member has a number of recesses or cut-outs for engagement directly or indirectly by the actuating member, to provide a number of different open positions of the damper element, of various degrees of opening, a force being applied directly or indirectly to cam one or more elements of said actuating member such that the respective recess or cut-out will cease to be engaged and the damper element will move into its closed position when the actuating member exerts no pressure on the retention member.

16. The damper of claim 1, wherein the protruding end portion of the movable member actuates a microswitch.

17. The damper of claim 1, wherein the body member and movable member are in the form of a removable cartridge.

18. A damper for an air flow duct comprising:

ducting;

a rotary damper element located internally from an inner surface of a circumferential wall of the ducting, the rotary damper element carried on an axle in the ducting and movable between a closed position and an open position;

biasing means biasing the damper element into its closed position; and retention means retaining the damper element in an open position, the retention means comprising:

an actuating member;

a retention member which is fixed relative to the damper element and is secured by the action of the actuating member to retain the damper element in an open position, which securing can be released to release the damper element so that it is moved by the biasing means into its closed position;

a support member fixed to the inner surface of the circumferential wall of the ducting and supporting at least part of the retention means, the support member having a base and at least a first limb, at a substantial angle to the base, which limb is adjacent the inner surface of the circumferential wall of the ducting and has a notch on its open end passing over the damper element axle; and securing means securing the limb to the inner surface of the circumferential wall of the ducting at a position between the axle and the base of the support member.

19. The damper of claim 18, wherein the support member has a further limb on the opposite side of the retention member to the actuating member, which further limb acts as a backing piece and wherein the support member has a further limb in the form of a sprung piece on the same side of the retention member as the actuating member, which sprung piece is pressed against the retention member by the actuating member when the damper flap is retained in an open position, whereby when the damper flap is retained in an open position, the actuating member presses the sprung piece against the retention member which in turn is pressed against the backing piece.

20. A damper for an air flow duct comprising:

ducting;

a damper element located internally from an inner surface of a circumferential wall of the ducting and movable between a first, closed position and a second, open position;

biasing means biasing the damper element into its closed position; and retention means for retaining the damper element in an open position, the retention means comprising:

an actuating member;

a retention member which is fixed relative to the damper element and which can be secured by the actuating member bearing on the retention member to retain the damper element in an open position, which securing can be released by movement of the actuating member away from the retention member to release the damper element so that the damper element is moved by the biasing means into its closed position;

a body member which is fixed to an opening in the inner surface and an outer surface of the circumferential wall of the ducting, the body member having a through-hole which passes from an exterior to an interior of the body member; and a movable member in the through-hole and arranged so that it moves when the actuating member moves, the movable member being arranged such that it protrudes or protrudes further from an opening in the exterior of the body member externally from the outer surface of the circumferential wall of the ducting when the actuating member moves to release the damper element.

21. A damper for an air flow duct comprising:

ducting;

a damper element located internally from an inner surface of a circumferential wall of the ducting and movable between a first, closed position and a second, open position;

at least one spring element attached to the damper element, the at least one spring element biasing the damper element into its closed position; and a cartridge assembly having:

an actuating member;

a retention member which is fixed relative to the damper element and can be secured by the action of the actuating member to retain the damper element in an open position, which securing can be released by movement of the actuating member to release the damper element so that the damper element is moved by the at least one spring element into its closed position;

a body member which is fixed to an opening in the inner surface and an outer surface of the circumferential wall of the ducting, the body member having a through-hole which passes from an exterior to an interior of the body member; and a movable member in the through-hole and arranged so that it moves when the actuating member moves, the movable member being arranged such that it protrudes or protrudes further from an opening in the exterior of the body member externally from the outer surface of the circumferential wall of the ducting when the actuating member moves to release the damper element.

22. The damper of claim 21, wherein the actuating member comprises a temperature-sensitive element for releasing the retention member to release the damper element when the temperature-sensitive element reaches a certain temperature.

23. The damper of claim 21, wherein the protruding end portion of the movable member actuates a microswitch.

24. A damper for an air flow duct comprising:

ducting;

a damper element located internally from an inner surface of the circumferential wall of the ducting, the damper element carried on an axle in the ducting and movable between a closed position and an open position;

at least one spring element, the at least one spring element biasing the damper element into its closed position; and a cartridge assembly comprising:

an actuating member;

a retention member which is fixed relative to the damper element and is secured by the action of the actuating member to retain the damper element in an open position, which securing can be released to release the damper element so that it is moved by the at least one spring element into its closed position;

a support member fixed to the inner surface of the circumferential wall of the ducting and supporting at least part of the cartridge assembly, the support member having a base and at least a first limb, at a substantial angle to the base, which limb is adjacent the inner surface of the circumferential wall of the ducting and has a notch on its open end passing over the damper element axle; and a rivet securing the limb to the inner surface of the circumferential wall of the ducting at a position between the axle and the base of the support member.

25. The damper of claim 24, wherein the support member has a further limb on the opposite side of the retention member to the actuating member, which further limb acts as a backing piece, and the support member has a further limb in the form of a sprung piece on the same side of the retention member as the actuating member, which sprung piece is pressed against the retention member by the actuating member when the damper flap is retained in an open position, whereby when the damper flap is retained in an open position, the actuating member presses the sprung piece against the retention member which in turn is pressed against the backing piece.

* * * * *